United States Patent [19]

Vos et al.

[11] Patent Number: 4,846,634

[45] Date of Patent: Jul. 11, 1989

[54] WATER TO EMULSION TRANSFORMER

[75] Inventors: Godfrey G. Vos, Bedfordview; Derek E. Newman, Morningside Manor, both of South Africa; Leland H. Lyon, Roanoke, Va.

[73] Assignee: Ingersoll-Rand Company, Woodcliff Lake, N.J.

[21] Appl. No.: 132,813

[22] Filed: Dec. 14, 1987

[51] Int. Cl.[4] ..... F04B 9/10

[52] U.S. Cl. ..... 417/397; 417/400; 91/222; 91/226; 91/229

[58] Field of Search ..... 417/397, 400, 225; 91/222, 226, 229, 342

[56] References Cited

U.S. PATENT DOCUMENTS

| | | | |
|---|---|---|---|
| 496,898 | 5/1893 | Reagan, Jr. | 417/400 |
| 788,071 | 4/1905 | Schiffbauer | 417/400 |
| 3,072,103 | 1/1963 | Herrmann | 91/226 |
| 3,363,575 | 1/1968 | Potts | 417/400 X |
| 4,212,597 | 7/1980 | Mallofre | 417/225 |
| 4,286,929 | 9/1981 | Heath et al. | 91/229 X |

*Primary Examiner*—Leonard E. Smith

*Attorney, Agent, or Firm*—Walter C. Vliet

[57] ABSTRACT

Disclosed is a device for converting pressure fluid input of one fluid to pressure fluid output of a second fluid without contaminating either fluid. The transformation is accomplished by a unique H section piston which cooperates the internally protruding endcaps enclosed in a double ended cylinder; the piston having a central control valve which reverses the piston on control pin end of stroke contact. Positive reverse action is obtained by means of endcap plungers which operate in response to piston position and pressure of the one fluid. The device is double acting and is enclosed totally within a single cylindrical module which is compact and inexpensive to manufacture.

14 Claims, 1 Drawing Sheet

WATER TO EMULSION TRANSFORMER

BACKGROUND OF THE INVENTION

In deep mines and in certain other areas where enormous head of water is available to power equipment there is a need for rock drills and other devices which can be powered by such hydropower installations. Hydraulic rock drills which operate on a 5/95 oil and water emulsion are now commercial. However, they will not effectively work on pure water. There exists therefore a need for mine worthy devices which can transform the potential energy of a hydropower installation into a pressure fluid which can power commercially available emulsion driven rock drills. Intensifiers, typically oil to water, are common pieces of machinery. The difficulty of the hydropower requirement is that unlike conventional fluid transformers (which use oil to lubricate complex control valves) the valving must operate in corrosive nonlubricating water. In order to insure successful operation of a transformer used in a mine the device must be simple, reliable and durable. Due to the complexities of the existing art it is felt that the device according to the present invention will provide an advantage to the industry.

OBJECTS AND SUMMARY OF THE PRESENT INVENTION

The device herein described comprises a pressure fluid transformer having a minimal number of working parts all of which are safely enclosed in its workings and in a surrounding cylindrical package thus making it more reliable. The unique packaging of the control valve an its porting functions contribute to the improvement of this device over present technology. It is an object of the present invention to provide a pressure fluid transformer which converts the power of one pressure fluid to power in a second pressure fluid the first of said fluids being a relatively corrosive nonlubricating fluid or similar fluid requiring separation from a second relatively workable fluid. It is a further object of this invention to accomplish the transformation within a simple, reliable and easy to manufacture package. These and other objects are obtained in a pressure fluid transformer comprising:

- a cylinder;
- a piston means of "H" cross section disposed within the cylinder;
- endcap means for the cylinder having a reduced diameter portion which cooperates internally with the "H" section piston to form a first and a second volume internal of the piston and a first and a second volume external of the piston;
- valve means internal of the piston for directing pressure fluid received intermediate of the piston and alternatively supplied to the first and the second internal volumes to reciprocate the piston;
- a second pressure fluid communicating with the first and second external volume of the reciprocating piston for compressing the second pressure fluid and supplying the second pressure fluid to a second operating system.

DESCRIPTION OF THE PREFERRED EMBODIMENT

Figure 1:
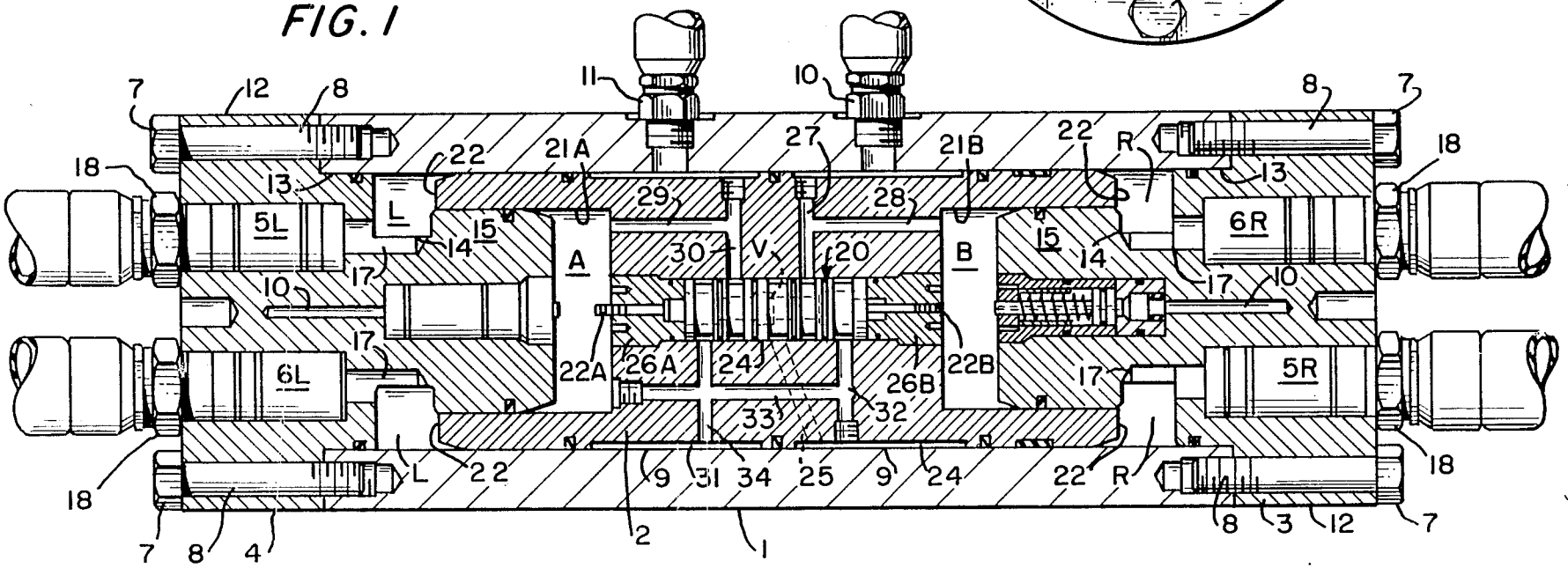
FIG. 1 is a longitudinal cross section of a transformer assembly incorporating the preferred embodiment of the present invention.

The configuration of the device is shown in FIG. 1. Other system hardware such as water inlet piping and emulsion conditioning equipment are not shown but are of conventional nature and construction. The transformer according to the present invention is comprised a cylinder 1 enclosed by two endcaps, right hand endcap 3 and left hand endcap 4 which retain the assembly and house the emulsion inlet check valves 5L and 5R and the emulsion outlet check valves 6L and 6R. The endcaps are bolted to the cylinder 1 by means of endcap bolts 7. Enclosed within the cylinder 1 is an "H" section piston 2 which reciprocates within the encapsulated space provided by the two endcaps and the cylinder.

A source of the first pressure fluid which according to the present embodiment is water is provided to the transformer assembly through water inlet port 10 which is a simple threaded connection in the preferred embodiment. The first pressure fluid is exhausted by a water exhaust port 11 which likewise is a simple threaded connection. The piston is comprised of an "H" section that contains a four-way pressure fluid or water controlled valve 20 which controls the movement of the piston 2 to reciprocate back and forth between the endcaps 3 and 4. The ends of the piston communicate to volumes A and B and L and R which are either increased or decreased depending on the direction the piston moves.

The two end volumes (L and R) are communicated through the emulsion (or oil) system to check valves 5L and 5R which draw fluid from a storage tank upon increasing volume and expel fluid to the system at pressure through check valves 6L and 6R upon decreasing volume. The direction of the piston motion is dictated by the pressures in water chambers "A" and "B" which are controlled by the position of a 4 way spool valve 20. The valve is communicated to high and low pressure water through holes drilled through the piston.

The cylinder is essentially formed from a single thick walled hollow cylinder or pipe having its ends tapped and threaded 8 for receiving endcap bolts 7. The cylinder 1 is also provided with circumferential undercuts 9 at the water supply inlet port 1 and the exhaust water outlet port 11 to aid in water distribution.

The endcaps are formed from an essentially solid cylinder having a first larger diameter 12 at the outside ends which conform to the diameter of the cylinder 1 and cooperate with the ends of the cylinder to form the enclosure. The endcaps are also provided with a second slightly smaller diameter 13 which cooperates internally with the cylinder 1 to form a seal. The endcaps are further reduced in diameter or necked down at a section designated 14 which forms the trapped volumes L and R and a bulbus end 15 which cooperates with the internal cylinder cavities 21A and 21B formed within the piston 2 to form variable volumes A and B.

Appropriate sealing is provided between the endcaps and the piston and cylinders as shown. Sealing may be accomplished in various parts of the present invention by means of O rings, piston rings or other similar sealing methods depending on the fluids involved and the degree of sealing protection required. The check valves 5L, 5R, and 6L, 6R are inserted in bores in the endcap which communicate with the variable volumes L and R respectively via passageways 17. The check valves are retained in their respective bores by means of threaded connectors 18 which are conveniently of the type utilized to connect either pipe or hose as a means of conveying emulsion from the reservoir tank to the operating systems (not shown). The endcaps are also provided with a central bore 19 which provides convenience of assembly and bleeding of the internal device. The central bores 19 are closed by a conventional set screw plug.

As indicated, the piston is of "H" longitudinal section having extreme ends 22 which cooperate with the cylinder 1 and the endcaps 3 and 4 to form variable volumes L and R upon reciprocation of the piston 2. In addition, the bulbus end 15 of the endcaps 3 and 4 cooperate with the internal bore 21A and 21B of the piston which form internal variable volumes A and B in the piston. The 4-way valve 20 supplies the inlet water pressure fluid from inlet port 10 alternately to variable volumes A and B and alternatively exhaust volume A and B to exhaust water port 11.

The 4-way control valve 20 is a spool valve, valve switching is accomplished by movement of the spool 50 which in turn is moved by the valve control pins 22A and 22B as they are pushed by the endcaps 3 and 4. As the valve assembly travels with the piston chambers A and B are communicated to either supply or exhaust pressure. The pressure difference created by the position of the valve also insures the valve is held in position until it is mechanically moved by the valve control pins. The cylinder will always move so that the distance between the extended pin and its corresponding endcap will decrease. Once the pin contacts the endcap the valve is held stationary while the cylinder remains in motion. The piston continues to move until the pressure in chambers A and B are reversed by virtue of the spool 50 position relative to the piston.

As shown in FIG. 1 the piston is travelling towards the left with inlet water being provided by the water supply inlet 10 about a distribution undercut 24 formed in the outside diameter of the piston to central supply port 25 to the spool chamber 26 which is essentially a bore in the piston having enclosures by the activating pin assemblies 26A and 26B which may be conveniently screwed into the ends of the spool bore 24. As shown, pressure fluid from the central supply support 25 is distributed through spool bore 24 to cross bore 27 and thereafter through longitudinal bore 28 to variable volume B. This forces the piston to the left as shown. Exhaust water in variable volume A is expelled through longitudinal port 29 to cross port 30 which enters the spool valve 20 and through internal valve porting is expelled through cross port 34 into an annual undercut 31 in the piston which communicates with exhaust port 11. Upon the piston reaching the extreme left the operating pin 22A will strike the valve actuating plunger 40 causing the valve spool to be reversed at which point the inlet pressure supply water will be transmitted to the spool valve through central supply port 25 and through internal porting be distributed to cross port 30 and to longitudinal port 29 to variable volume A causing the piston to be driven to the right. Exhaust water exiting volume B will be transferred to longitudinal port 28 to cross port 27 and eventually exhausted through cross port 32, longitudinal port 33, cross port 34, circumferential undercut 31 and eventually through exhaust water outlet port 11.

Valve actuation is positively assisted by the movement of plungers 40 which push the spool valve 50 when a fluid conveying or motion control orifice 41 is blocked. Water or similar first pressure fluid from port 10 is directed to plunger supply port 42 by a passageway (not shown) which is connected to a fixed flow control orifice 43 which restricts flow to the plunger piston 40. The end of the plunger 40, which can come in contact with pin ends 22A and 22B, contains a small motion control orifice 44 which is much less of a restriction than the flow control orifice 43. When the plunger end motion control orifice 44 is not blocked by valve pins 22A and 22B the plunger piston pressure is at the same level as chamber pressures "A" and "B". Because no difference in pressure exists across the plunger piston 45, the plunger is held retracted by a spring 46. Once the piston 2 moves so that the pin ends 22A or 22B restrict flow through the motion control orifice 44, pressure rises behind the plunger piston 45 and the plunger moves toward chambers "A" or "B" and thereby assists in moving the valve. The rate at which the plunger extends is determined by the size of the fixed flow control orifice 43. Once the plunger extends to the point where a pressure reversal between "A" and "B" is attained, the remainder of the valve switch occurs due to the reversing pressures. Once the pin ends 22A or 22B are no longer in contact with the motion control orifice the plunger piston pressure drops and the spring retracts the plunger 40.

The addition of this device to the invention ensures that a valve switch will occur under all conditions.

The reciprocating motion thus created varies volume L and R. Upon increasing volume at L or R emulsion from the reservoir tank is drawn in via check valves 5L and 5R to volumes L and R respectively and upon decreasing volumes, at L and R, are expelled to the operating systems through check valves 6L and 6R. In this manner as one skilled in the art will now readily understand the power from the inlet supply water is supplied to the piston and in turn converted or transformed to pressure fluid in the emulsion side for use elsewhere.

In a second preferred application, two different second pressure fluids may be supplied and compressed, one at each end of the device described, or the same second pressure fluid may be supplied in equal proportion to two different operating machines.

Figure 2:
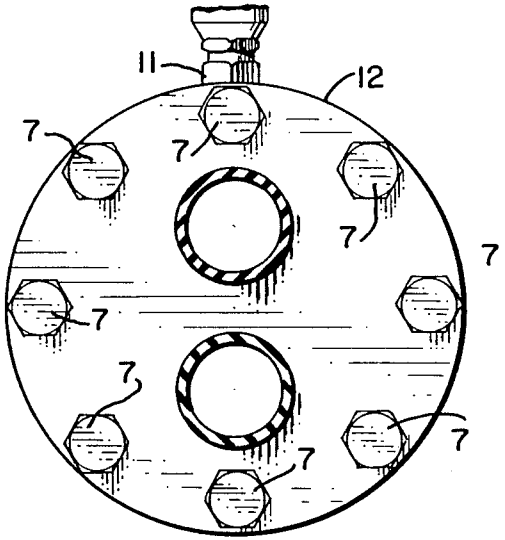
FIG. 2 is an end view of the cylindrical device showing the right hand endcap, the left hand endcap being essentially identical.
Figure 3:
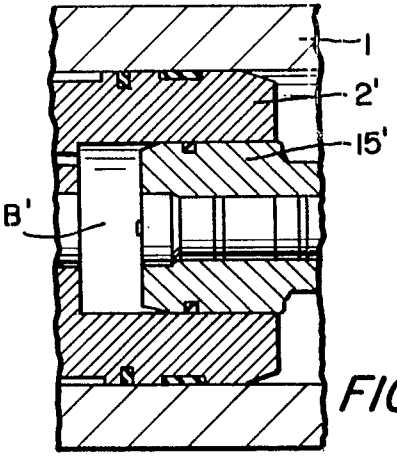
FIG. 3 is a partial revised longitudinal cross section of a transformer assembly according to FIG. 1 incorporating a second preferred embodiment of the present invention.

In another preferred application shown in FIG. 3 a smaller (as depicted) or larger diameter bulbus end 15 may be used on either side in cooperation with a greater or smaller bore in the piston 2' as a means of directly proportioning one fluid or two different fluids as a proportioned supply. In this way it is possible for two or three fluids to be directly proportioned in different proportions, for example a first fluid may be compressed and supplied to port 10, a second fluid supplied at check valve 5L and the second or a third fluid supplied at check valve 5R. It should be obvious to one skilled in the art that proportioned fluid amounts will be supplied at port 11 and check valves 6L and 6R on each stroke of piston 2.

Having described my invention in terms of a preferred embodiment I do not wish to be limited in the scope of my invention except as claimed.

I claim:

1. A device for proportioning pressure fluid operated by a first pressure fluid as a means of compressing a first and second proportioned fluid comprising: a cylinder; a piston means of substantially "H" longitudinal section disposed within said cylinder; endcap means for said cylinder having a different reduced diameter portion which cooperates internally with said substantially "H" section piston to form a first and a second volume external of said piston; an inlet means in said cylinder for receiving a first pressure fluid; valve means internal of said piston for directing said first pressure fluid received in said cylinder intermediate of said piston and alternatively supplied to said first and said second internal volumes to reciprocate said piston; and outlet means for exhausting said first pressure fluid; a checked inlet port means in each end for receiving a first and second fluid to be proportioned and compressed communicating with said first and said second external volume of said reciprocating piston for supplying said first and said second proportioned fluid to an external system via a checked outlet port means for each of said first and said second fluids to be proportioned.

2. A device for converting the power of a first pressure fluid into a second pressure fluid without contamination there between comprising: a cylinder of circular cross section; a piston means of circular cross section and "H" longitudinal section disposed within said cylinder; endcap means for said cylinder having a bulbus reduced diameter portion which cooperates internally with said "H" section piston to form a first and second internal volume of said piston and a first and second volume external of said piston; said first and said second external volume being formed between said piston and said cylinder and said endcap; spool valve means in an internal bore of said piston for directing said first pressure fluid received in inlet means intermediate of said piston and alternatively supplied to said first and said second internal volumes to reciprocate said piston; a second pressure fluid communicating through checked inlet port means with said first and said second external volumes of said reciprocating piston for compressing said second pressure fluid and supplying said pressure fluid to a second operating system.

3. A device for converting the power of a first pressure fluid into power in a second pressure fluid without contamination there between comprising: a cylinder; a piston means of "H" longitudinal section disposed within said cylinder; endcap means for said cylinder having a reduced diameter portion which cooperates internally with said "H" section piston to form a first and a second volume internal of said piston and a first and a second volume external of said piston; an inlet means in said cylinder for receiving a first pressure fluid; valve means internal of said piston for directing said first pressure fluid received in said cylinder intermediate of said piston and alternatively supplied to said first and said second internal volumes to reciprocate said piston; an outlet means for exhausting said first pressure fluid; a checked inlet port means for receiving a second pressure fluid communicating with said first and second external volume of said reciprocating piston for compressing said second pressure fluid and supplying said second pressure fluid via a checked outlet port means to a second operating system.

4. A power transforming device according to claim 3 wherein: said cylinder, said piston, and said endcaps are of circular cross section.

5. A power transforming device according to claim 3 wherein: said first pressure fluid is water and said second pressure fluid is a hydraulic or hydraulic water emulsion fluid.

6. A power transforming device according to claim 3 wherein: said endcaps are provided with check valves and ports to supply said second pressure fluid.

7. A power transforming device according to claim 3, which is double acting and packaged within a duplicated end for end cylinder containing a symmetrical end for end piston enclosed by duplicate endcaps, thereby permitting the same fluid or two different fluids to be compressed in the ends of a single enclosed unit.

8. A power transforming device according to claim 1 wherein: said valve means is a spool piece.

9. A power transforming device according to claim 8 wherein: said spool valve is assisted to its operating position by means which contact said endcaps.

10. A power transforming device according to claim 9 wherein: said means which contacts said endcaps are pins.

11. A power transforming device according to claim 1 wherein: said piston is assisted in its movement from said endcaps by means of a plunger.

12. A power transforming device according to claim 11 wherein: said plunger is operated by restricting an orifice in said plunger which transmits said first pressure fluid to said first or second volume internal of said piston.

13. A power transforming device according to claim 11 wherein: said plunger is operated by said first pressure fluid.

14. A power transforming device according to claim 13 wherein: said plunger is located in said endcaps.

* * * * *